United States Patent [19]

Koutonen

[11] Patent Number: 4,730,438

[45] Date of Patent: Mar. 15, 1988

[54] APPARATUS AND METHOD FOR THE ARRANGEMENT AND PACKAGING OF ROLLS

[75] Inventor: Pauli Koutonen, Jokela, Finland

[73] Assignee: Valmet Paper Machinery Inc., Helsinki, Finland

[21] Appl. No.: 826,602

[22] Filed: Feb. 6, 1986

[30] Foreign Application Priority Data

Feb. 8, 1985 [FI] Finland ..... 850533

[51] Int. Cl.[4] ..... B65B 59/00

[52] U.S. Cl. ..... 53/409; 53/415; 53/502; 53/504; 198/505

[58] Field of Search ..... 53/409, 204, 410, 415, 53/502, 503, 504, 542, 532, 137; 198/505, 347, 356, 358

[56] References Cited

U.S. PATENT DOCUMENTS

| | | | |
|---|---|---|---|
| 3,670,877 | 6/1972 | Reed | 53/409 X |
| 3,968,622 | 7/1976 | Kataoka | 53/504 |
| 4,545,179 | 10/1985 | Rebsamen | 53/504 X |
| 4,548,286 | 10/1985 | Sashiki et al. | 53/502 X |
| 4,550,550 | 11/1985 | Scott | 53/504 X |
| 4,564,103 | 1/1986 | Sashiki et al. | 198/505 X |

*Primary Examiner*—James F. Coan

*Attorney, Agent, or Firm*—Birch, Stewart, Kolasch & Birch

[57] ABSTRACT

The invention concerns a method for arranging paper rolls coming, e.g. from a winder into a package suitable for delivery. The rolls are identified, end-labelled, and their width, weight and diameter are measured, whereupon a package is formed of a suitable number of rolls at a wrapping station. According to the invention, the rolls are transferred, each in its turn, to a positioning station, where they are identified and end-labelled one by one, whereupon the identification data and measurement data of each roll as well as of a preceding roll, if any, placed in the waiting position of the positioning station, are compared with the specification data of the package to be delivered. When said data of the rolls correspond to the specification data of the package, the rolls are transferred to the wrapping station, whereas, in the contrary case, the rolls are shifted to the waiting position of the positioning station. Thus, this acts as a sort of a buffer store for paper rolls. The most important items among the specification data are the delivery addresses of the rolls and the total width and weight of the rolls.

18 Claims, 1 Drawing Figure

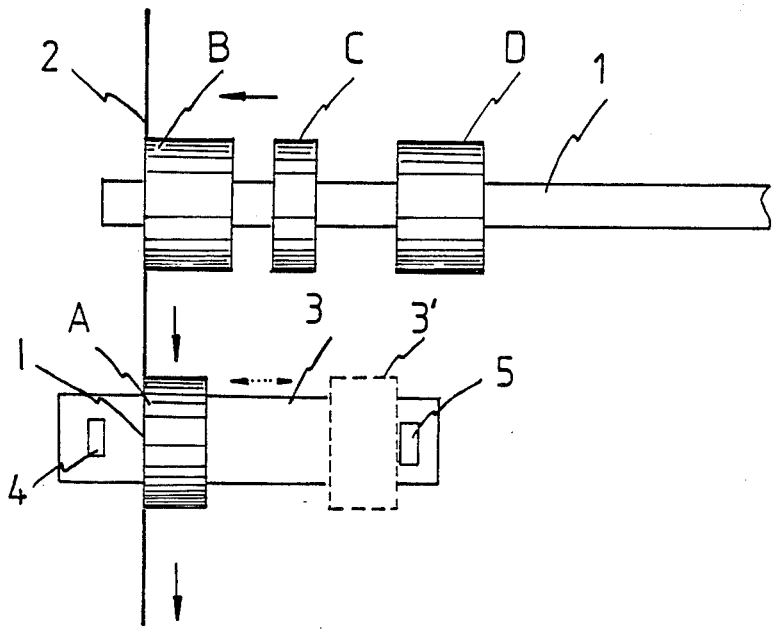
2
B
C
D
1
A
3
3'
1
5
4

APPARATUS AND METHOD FOR THE ARRANGEMENT AND PACKAGING OF ROLLS

BACKGROUND OF THE INVENTION

The present invention concerns a method for the arrangement of rolls, in particular of paper rolls, into a package suitable for delivery. According to this method, the rolls are identified, end-labelled, and their length, weight and diameter are measured, whereupon a package is formed of a suitable number of rolls at the wrapping station.

At present, various roll packaging lines are commonly used for paper rolls coming from apparatus for paper finishing. As an example of these lines reference may be made to the packaging line described in the GB Pat. specification No. 2,044,713, in which paper rolls of different sizes are transferred axially, i.e., in the longitudinal direction, along a transfer track from one treatment station to the other. At the treatment stations the rolls are identified, measured and weighed, end-labelled, wrapped, as well as provided with inner and outer headers. Said packaging line is well suitable for the transfer and handling of individual rolls, which are often very heavy. This is the case in particular because, by means of the axial mode of transfer, it is possible to avoid the drawbacks resulting from rolling of the roll around the longitudinal axis.

When it has been desirable to form a so-called multi-roll package out of two or more rolls, so far the rolls have been grouped in package groups right at the winder. Thus is has been necessary to perform the end-labelling of two rolls using two separate labelling devices, one for each roll. If there have been at least three rolls, the end-labelling of the middle rolls has, on the whole, not been possible.

SUMMARY OF THE INVENTION

An object of the present invention is to provide an apparatus and method for packaging a group of paper rolls. The invention is based on the idea that the rolls are transferred, each in its turn, to at least one positioning station, where they are identified and endlabelled one by one, whereupon specification data, such as identification data or measurement data, of each roll as well as of a preceding roll, if any, placed in the waiting position of the positioning station, are compared with the predetermined corresponding specification data based on the package to be delivered and/or its size. If the specification data of the roll or rolls placed at the positioning station correspond to the specification data of the package, the roll or rolls are transferred to the wrapping station. In the contrary case, the roll/rolls are shifted to the waiting position of the positioning station. Thus, the positioning station acts as a sort of a buffer store for paper rolls. The most important items among said specification data are the addresses of delivery of the rolls to be included in a multi-roll package as well as their total width and weight.

For the purposes of this invention, the phrase "the rolls belonging to the same package group" means the rolls formed out of one and the same paper quality and having at least substantially equally large diameters.

The method of the present invention may preferably, but not exclusively, be used for paper rolls coming from an apparatus for paper finishing, e.g. a winder. The rolls are transferred preferably, but not necessarily, in the way described in the GB Pat. specification No. 2,044,713, i.e. axially by means of a conveyor, from which each roll is rolled to the positioning station, and from there further to the wrapping station.

When there is only one positioning station, the different packing groups are handled one at the time, i.e. all the rolls belonging to the same packing group are transferred to said station in a row, one after the other. However, the provision of several positioning stations placed one after the other makes it possible to handle rolls belonging to different packing groups in mixed order. In the last mentioned case, the number of separate positioning stations preferably corresponds to the number of different packing groups to be handled.

By means of the invention, remarkable advantages are obtained as compared with prior art. Thus, the rolls need not be arranged in advance into groups suitable for the packages to be delivered. As mentioned above, using one positioning station it is, however, required that the rolls belonging to the same package group arrive on the conveyor to the positioning station one after the other. According to the method, it is possible to label an unlimited number of rolls by means of one labelling apparatus. After the last roll of the package has been identified, the group can be transferred immediately to the wrapping station. In the method it is, moreover, possible to perform an automatic and computer-based regrouping of the rolls after, e.g. a winder. Since one important item of identification data consists of the address of delivery, it can be made sure that a multi-roll package contains only rolls to be delivered to the same customer.

Further scope of applicability of the present invention will become apparent from the detailed description given hereinafter. However, it should be understood that the detailed description and specific examples, while indicating preferred embodiments of the invention, are given by way of illustration only, since various changes and modifications within the spirit and scope of the invention will become apparent to those skilled in the art from this detailed description.

BRIEF DESCRIPTION OF THE DRAWING

The present invention will become more fully understood from the detailed description given hereinbelow and the accompanying drawings which are given by way of illustration only, and thus are not limitative of the present invention, and wherein:

The FIGURE is a plan view of an embodiment of the present invention.

As shown in the FIGURE, the rolls A, B, C, D are transferred by means of a conveyor 1 axially from an apparatus for paper finishing, e.g. a winder, to a transfer track 2. On the transfer track 2, each roll in its turn (in the figure the roll A) moves first to the positioning station 3. This comprises an oblong transfer track, which consists of, e.g., transversally mounted, freely revolving auxiliary rolls, which are positioned obliquely relative the horizontal plane and which are inclined towards each other so that they form a sort of a transfer trough. The positioning station 3 further includes positioning devices 4 and 5 placed at both ends of the transfer track, whereat the rolls can be shifted from one end of the transfer track to the other end by means of the movement of said positioning devices. When roll A arrives at the station 3, the positioning devices 4 and 5 position it for wrapping. At the positioning station 3, identification of the roll A, end-labelling of the end I of roll A, and measurement of the width, the diameter and the weight of the roll A are performed. If it is ascertained at the identification stage, for example on basis of the delivery address of the roll, that the roll must be packed alone, it is transferred to a wrapping station. On the other hand, if the roll is identified as a roll that is to be packed in a multi-roll package, the positioning device 5 moves to its home position, i.e. to its rear position, and the positioning device 4 pushes the roll A to the waiting position 3', which is illustrated with broken lines in the drawing.

The next roll B is transferred to the positioning station. The positioning devices 4 and 5 position the rolls A and B for wrapping, whereupon the roll B is identified, end-labelled, and its diameter, weight, as well as the total width of the rolls A and B is measured. If it is possible to ascertain, on basis of the identification data of the rolls A and B or by means of the width or weight measurement A+B, that the package group will include only rolls A and B, the rolls are transferred as a pair to wrapping. If a further roll C or further rolls C and D must be included in the package, the positioning device 5 is shifted to its home position, and the positioning device 4 pushes the group of rolls A+B to the waiting position 3'.

By means of the arrangement described above, the rolls to be included in a group of rolls can be end-labelled (on end I) as soon as they arrive at the positioning station 3 for positioning. The rolls are collected in the waiting position at the positioning station until there are a number of rolls suitable for a multiroll package with the aid of the specification data of a suitable multi-roll package, contained, e.g., in a computer-based system, as well as the data received from the positioning station and related to each roll (i.e. identification and measurement data of the rolls present in the positioning station) and the data of identification and overall width and weight of the group of rolls.

Within the scope of the invention, solutions differing from the exemplifying embodiment described above are also possible. Thus, as mentioned above, in place of one positioning station, it is possible to use several subsequent stations. In this way, roll consignments destined to different buyers will be separated efficiently with roll packages of suitable size formed for each buyer at the positioning stations functioning as buffer stores.

The identification of each roll may also be performed before said position stations, e.g. at separate roll identifying stations.

The invention being thus described, it will be obvious that the same may be varied in many ways. Such variations are not to be regarded as a departure from the spirit and scope of the invention, and all such modifications as would be obvious to one skilled in the art are intended to be included within the scope of the following claims.

What is claimed is:

1. A method of arranging rolls, in particular paper rolls, into a package suitable for delivery, comprising the steps of:

transferring the rolls, each in its turn, to at least one positioning station, identifying and end-labelling said rolls one by one, measuring the width, weight and diameter of said rolls, comparing identification data and measurement data of each roll together with the corresponding data of at least one preceding roll, if any, placed in a waiting position at the positioning station, with predetermined specification data of the package to be delivered, and, when said identification data and said measurement data of at least one roll received at said positioning station corresponds to said specification data of the package, transferring the at least one roll to a wrapping station.

2. The method according to claim 1, wherein the total width of the rolls is used as specification data.

3. The method according to claim 1, wherein the total weight of the rolls is used as specification data.

4. The method according to claim 1, wherein delivery addresses are used as specification data.

5. The method according to claim 2, wherein a combination of data corresponding to total width, total weight and delivery addresses of the rolls is used as specification data.

6. The method according to claim 1, wherein only one positioning station is used and wherein all the rolls belonging to the same package group are transferred one after the other to said positioning station.

7. The method according to claim 1, wherein several positioning stations are placed one after the other.

8. A method as claimed in claim 3, wherein a combination of said specification data is used as specification data.

9. A method as claimed in claim 4, wherein a combination of said specification data is used as specification data.

10. A method as claimed in claim 2, wherein only one positioning station is used, further comprising transferring all the rolls belonging to the same package group one after the other to said positioning station.

11. A method as claimed in claim 2, wherein several positioning stations are placed one after the other.

12. A method of arranging and packaging rolls of material comprising the steps of:

transferring the rolls, one at a time, to a positioning station;

measuring the width, diameter and weight of each roll;

identifying and labelling each roll;

accumulating at least one identified and labelled roll at said positioning station in an axial direction until a predetermined order for material can be met; and wrapping said at least one roll for shipment.

13. The method according to claim 12, wherein said rolls are each labelled on an end.

14. An apparatus for arranging and packaging rolls of material comprising:

a first transfer means for transporting the rolls one at a time to a first position;

measuring means for measuring the width, length and weight of each roll;

positioning means located at said first position for positioning and accumulating at least one roll until a predetermined order for material can be met; and wrapping means for wrapping said at least one roll for shipment.

15. The apparatus according to claim 14, wherein said measuring means is positioned at said first position.

16. The apparatus according to claim 14, including labelling means for labelling each roll.

17. The apparatus according to claim 14, including a labelling means for labelling an end of each roll.

18. The apparatus according to claim 14, wherein said positioning means accumulates rolls end to end.

* * * * *